US008511694B2

(12) United States Patent
Bradshaw et al.

(10) Patent No.: US 8,511,694 B2
(45) Date of Patent: Aug. 20, 2013

(54) REVERSIBLE WALKER ASSEMBLY

(76) Inventors: Scott N. Bradshaw, Spangle, WA (US); Bernarde Linde, Deer Park, WA (US)

( * ) Notice: Subject to any disclaimer, the term of this patent is extended or adjusted under 35 U.S.C. 154(b) by 0 days.

(21) Appl. No.: 11/888,730

(22) Filed: Aug. 1, 2007

(65) Prior Publication Data

US 2009/0033052 A1 Feb. 5, 2009

(51) Int. Cl.
*A61H 3/04* (2006.01)

(52) U.S. Cl.
USPC ..... 280/87.021; 135/67

(58) Field of Classification Search
USPC ..... 280/87.021, 87.041, 47.39, 642, 280/647, 650; 135/67; 297/94, 115
See application file for complete search history.

(56) References Cited

U.S. PATENT DOCUMENTS

| | | | | |
|---|---|---|---|---|
| 5,772,234 | A * | 6/1998 | Luo | 280/642 |
| 5,816,593 | A * | 10/1998 | Che | 280/87.041 |
| 6,086,086 | A * | 7/2000 | Hanson et al. | 280/650 |
| 6,378,883 | B1 * | 4/2002 | Epstein | 280/250.1 |
| 6,651,994 | B2 * | 11/2003 | Hallgrimsson et al. | 280/87.041 |
| 6,854,754 | B1 * | 2/2005 | Easley, Jr. | 280/304.1 |
| 7,017,936 | B2 * | 3/2006 | Huang | 280/642 |
| 7,052,030 | B2 * | 5/2006 | Serhan | 280/304.1 |

* cited by examiner

*Primary Examiner* — Frank Vanaman

(57) ABSTRACT

An apparatus for assisting people with walking wherein those apparatus are reconfigurable to provide seating in either the forward-facing, or the rear-facing direction, includes a foldable, wheeled frame assembly, a seat mounted to the frame, and a reversible cross-arm, or backrest, for reconfiguring the apparatus from a rear-facing seating arrangement to a forward-facing seating arrangement. In a further aspect, hinged arms, one on each side of the frame assembly, are operable to at least partially rotate in a plane adjacent to the plane of the frame to which it is attached, thereby offering alternative positions of the arms that are convenient to the forward-facing seating position and the rear-facing seating position.

19 Claims, 13 Drawing Sheets

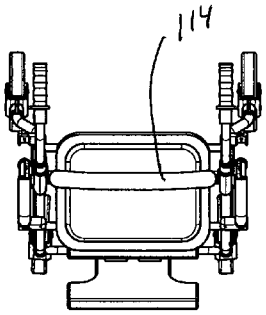
Fig. 10
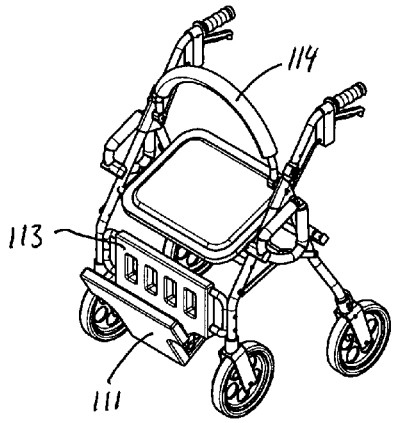
Fig. 9
Fig. 11
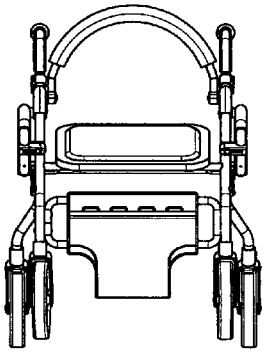
Fig. 12
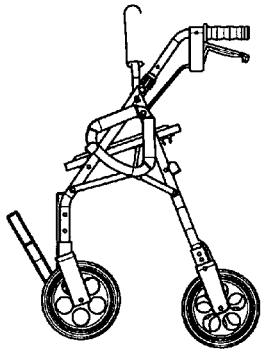
Fig. 13
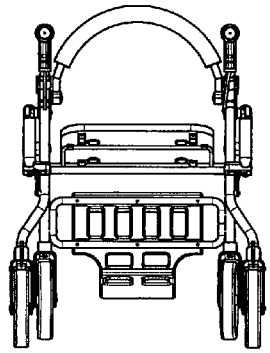

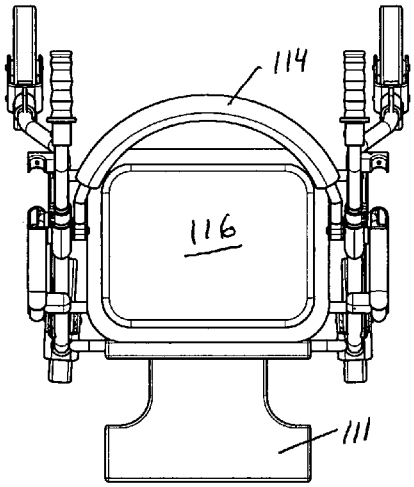
Fig. 15
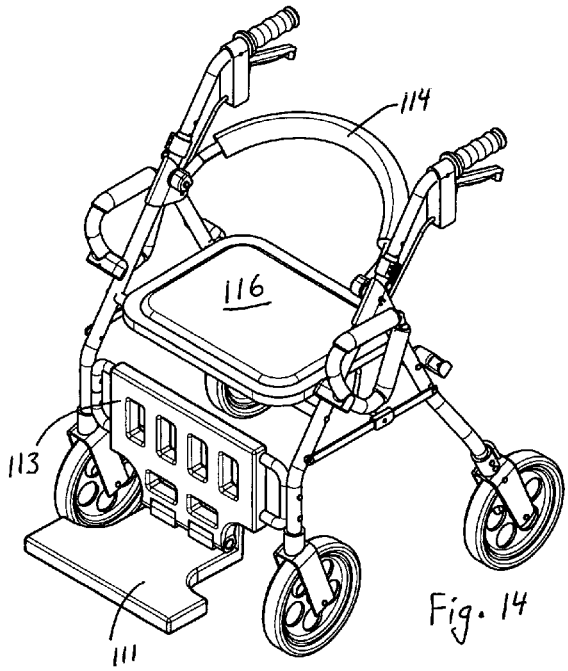
Fig. 14
Fig. 16
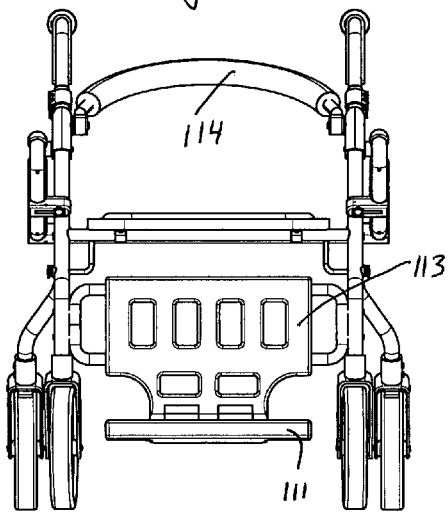
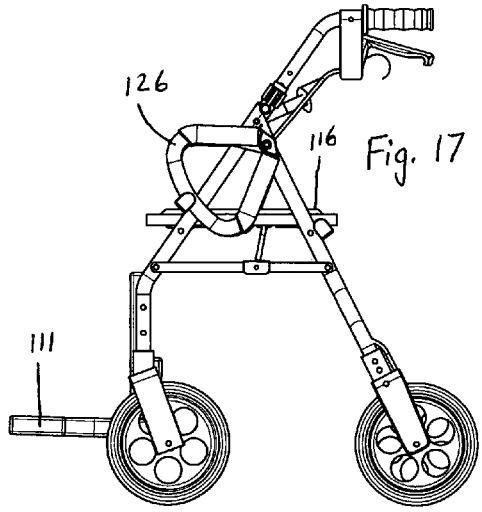
Fig. 17

REVERSIBLE WALKER ASSEMBLY

FIELD OF THE INVENTION

The present invention relates generally to mobility products for people that have difficulty walking, and more particularly relates to a walker that provides both support for walking and further provides convenient rear-facing and front-facing seating by way of mechanically transforming the arrangement of the components of the walker.

BACKGROUND

Many people, whether due to age, injury, or disease, require some form of mechanical apparatus, or assistive device, to help them remain mobile. Wheelchairs are one well-known means of providing some degree of mobility for those who cannot walk on their own. Another means for providing mobility assistance to people who have difficulty walking is a class of apparatus referred to as walkers.

Some walkers are essentially a frame upon which a person may lean for balance and support. Such walkers require a person to pick up the walker and reposition it so that that person may then step toward the new position of the walker while leaning thereon for support. Another type of walker includes wheels attached to the frame, forming a wheeled walker, so that the walker may be repositioned by rolling rather than by being lifted and moved.

Various wheeled walkers are known to provide a one or more of a variety of features such as hand-operated controls for engaging a braking mechanism to stop the walker, a basket for containing articles, foldable frames for compact storage, and a rear-facing seat suitable sitting and including a cross-arm that acts as a back to the rear-facing seat.

Unfortunately, the rear-facing seating arrangement of conventional wheeled walkers prevents a person from conveniently grasping the handles and moving the walker when the rear-facing seat is occupied.

What is needed are apparatus for assisting people with walking, wherein those apparatus are reconfigurable to provide seating in either the forward-facing, or the rear-facing direction.

SUMMARY OF THE INVENTION

Briefly, an apparatus for assisting people with walking wherein those apparatus are reconfigurable to provide seating in either the forward-facing, or the rear-facing direction, includes a foldable, wheeled frame assembly, a seat mounted to the frame, and a reversible cross-arm, or backrest, for reconfiguring the apparatus from a rear-facing seating arrangement to a forward-facing seating arrangement.

In a further aspect of the present invention, hinged arms, one on each side of the frame assembly, are operable to at least partially rotate in a plane adjacent to the plane of the frame to which it is attached, thereby offering alternative positions of the arms that are convenient to the forward-facing seating position and the rear-facing seating position.

BRIEF DESCRIPTION OF THE DRAWINGS

FIG. 9 is an isometric view of a reversible rolling walker, in accordance with the present invention, in the transformation configuration, where the walker is shown approximately midway through changing from a walking configuration to a front-facing configuration.

FIG. 10 is a top view of a reversible rolling walker in the transformation configuration.

FIG. 11 is a front view of a reversible rolling walker in the transformation configuration.

FIG. 12 is a side view of a reversible rolling walker in the transformation configuration.

FIG. 13 is a rear view of a reversible rolling walker in the transformation configuration.

FIG. 14 is an isometric view of a reversible rolling walker, in accordance with the present invention, in the front-facing chair configuration.

FIG. 15 is a top view of a reversible rolling walker in the front-facing chair configuration.

FIG. 16 is a front view of a reversible rolling walker in the front-facing chair configuration.

FIG. 17 is a side view of a reversible rolling walker in the front-facing chair configuration.

DETAILED DESCRIPTION

Generally, a rolling walker in accordance with the present invention is mechanically adapted to transform between several states, or configurations, including a walking configuration, a rear-facing seating configuration, and a forward-facing seating configuration. Various embodiments of the present invention include a hinged backrest operable to rotate at least between a rear-facing seating configuration and a forward-facing seating configuration. Various embodiments of the present invention may include hinged arms, one on each side of the frame assembly, which are operable to at least partially rotate in a plane adjacent to the plane of the frame to which it is attached, thereby offering alternative positions of the arms that are convenient to the forward-facing seating position and the rear-facing seating position.

Since the rolling walker of the present invention may be transformed into different configurations, such as, but not limited to, rear-facing and forward-facing seating configurations it may be referred to as a reversible walker. Another way of describing various embodiments is that a rolling walker in accordance with the present invention may be converted to a transport chair, and vice versa.

Reference herein to "one embodiment", "an embodiment", or similar formulations, means that a particular feature, structure, operation, or characteristic described in connection with the embodiment, is included in at least one embodiment of the present invention. Thus, the appearances of such phrases or formulations herein are not necessarily all referring to the same embodiment. Furthermore, various particular features, structures, operations, or characteristics may be combined in any suitable manner in one or more embodiments.

Terminology

The term "walker" refers generally to a device, or apparatus, that facilitates, or assists, people with various infirmities to walk, for the most part, unaided. Typically, a walker facilitates walking by providing a platform upon which a person can lean, or use their arms to support a portion of their weight, and/or to steady their balance.

A walker without wheels is sometimes referred to as a standard walker.

A walker with wheels may be referred to as a wheeled walker, a rolling walker, or a rollator.

Figure 1:
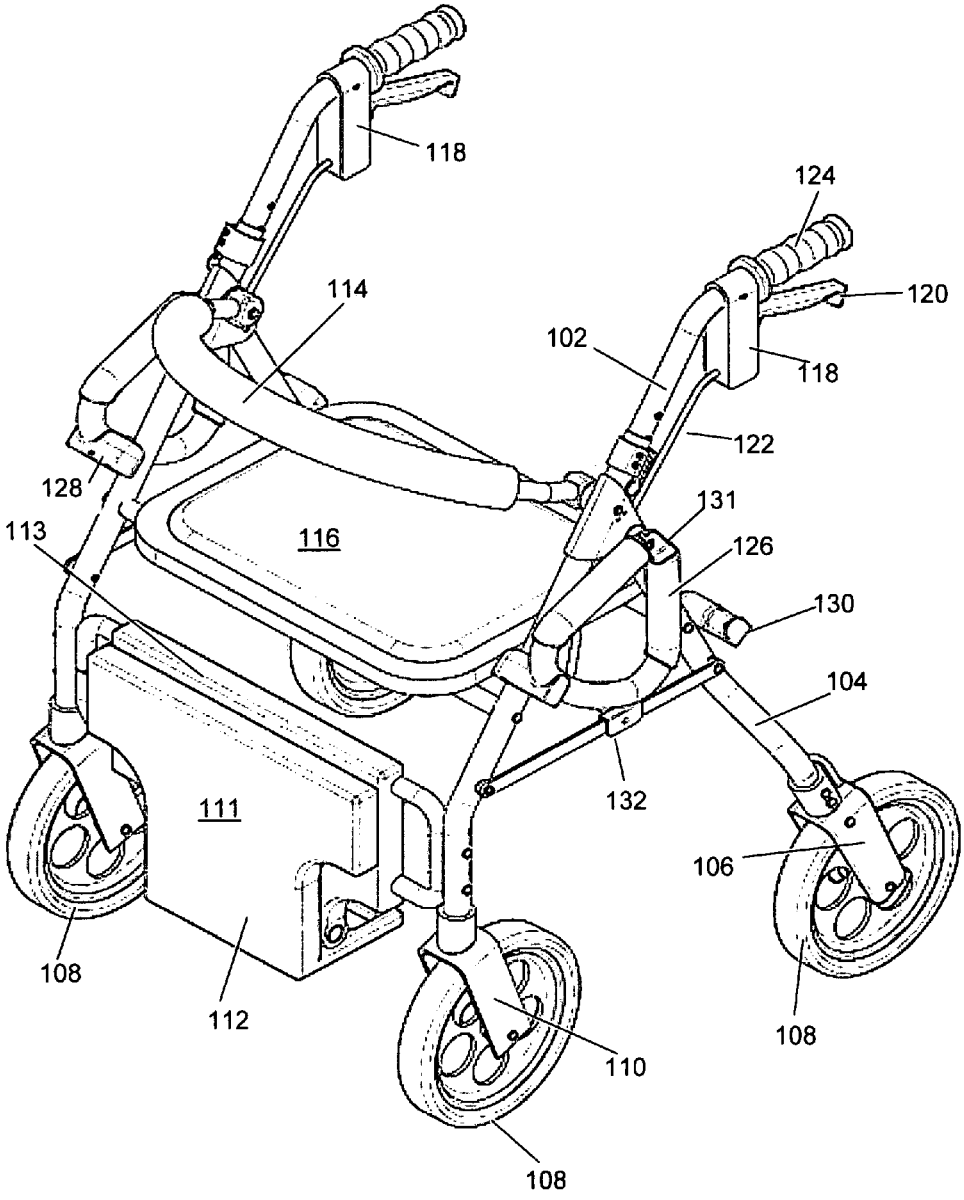
FIG. 1 is an isometric view of a reversible rolling walker, in accordance with the present invention, in the walking configuration.

FIGS. 1-4 provide various views of a reversible rolling walker in accordance with the present invention arranged in the walking configuration. The walking configuration is one in which the various elements of the reversible rolling walker in accordance with the present invention are arranged for convenient use as an assistive device for walking forward. Referring more particularly, FIG. 1, which is an isometric view of the reversible rolling walker, an illustrative embodiment of the present invention is described. A frame includes a pair of front members 102 and a pair of rear members 104. Front and rear members 102, 104 are tubular aluminum pieces. It is noted that any other suitable material may be used to form the constituent elements of the frame. Each rear member 104 is hingeably attached (i.e., coupled by a hinge so as to allow the attached elements may move relative to each other with respect to a fixed common point or points) to one of the pair of front members 102 as shown in FIG. 1. Each of front and rear members 102, 104 has a wheel mount 110 attached at a lower end thereof, and each wheel mount has a wheel 108 attached thereto. In the illustrative reversible rolling walker assembly of FIG. 1, each pair of hingeably attached front and rear members 102, 104 are oriented vertically and spaced apart from each other. Each pair of hingeably attached front and rear members 102, 104 are further connected by a cross-support 132 that is foldable at a mid-portion thereof.

A foldable footrest assembly 112 is disposed between the pair of spaced apart hingeably attached front and rear members 102, 104, and attached to each of front members 102 as shown in FIG. 1. Footrest assembly 112, includes a footrest backing plate 113 and a footrest 111 hingeably attached to footrest backing plate 113. Attachment of footrest assembly 112 to front members 102 is achieved in the illustrated embodiment by double pinning each side of footrest backing plate 113 to each corresponding front member 102. It is noted that any suitable means of attaching footrest backing plate 113 to front members 102 may be used, including, but not limited to, gluing and welding. In the illustrative embodiment of FIGS. 1-4 footrest 111 is in the folded-up, i.e., non-use, configuration.

Still referring to FIG. 1, a backrest 114 is disposed between the pair of spaced apart hingeably attached front and rear members 102, 104, and is hingeably attached to each of front members 102 as shown in FIG. 1. Further details of the backrest hinges are provide below in connection with the description of FIGS. 23-25. In the illustrated embodiment backrest 114 includes a tubular structural member and a covering layer that provides a soft, or padded, surface, suitable for a person to sit against. It is noted that the present invention is not limited to any particular material for either the backrest structural element or the backrest covering layer. For example, the backrest may comprise a structural element such as, but not limited to, a tubular element, a flat element, a square element, a rectangular element, or any element suitably shaped to perform the backrest function. Additionally, a seat 116 is disposed between the pair of spaced apart hingeably attached front and rear members 102, 104, and coupled to each of front members 102, and each of rear members 104 as shown in FIG. 1. In some embodiments, seat 116 is rotatably attached to front members 102, and is free to move relative to the point of rotatable attachment so that the whole walker assembly may fold up for storage. If the seat were fixedly attached to each of the front and rear members the walker assembly would be unable to fold up for storage.

In the illustrated embodiment of FIG. 1, a handbrake mechanism 118 is mounted on each of front members 102 at the handgrip end of each of front members 102. Handbrake mechanisms 118 are operable to turn sideways to facilitate folding and storage of the reversible rolling walker. Handbrake mechanism 118 receives a mechanical control input via a lever 120. A brake cable 122 is coupled to handbrake mechanism 118 and activates brakes at one or more wheels 108. A hand grip 124 is attached to each hand grip end of front members 102.

Still referring to FIG. 1, an arm 126 with rubber grips is hingeably coupled to each of front members 102 as shown. A front arm latch 128 is attached to each of front members 102, and a rear arm latch 130 is attached to each of rear members 104. In the illustrative embodiment, arm latches 128 and 130 are welded to the frame. Arm 126 is operable to rotate on its hinge 131 between front arm latch 128 and rear arm latch 130. Each of front arm latch 128 and rear arm latch 130 is operable, in conjunction with arm 126, to snap arm 126 into place so that arm 126 remains locked in its position until a release button under the arm latch is operated to release arm 126 from its locking engagement with the arm latch. The aforementioned rubber grips may be implemented as any suitable padding or covering, and the present invention is not limited to a particular material for these grips, or coverings, or paddings.

Figure 2:
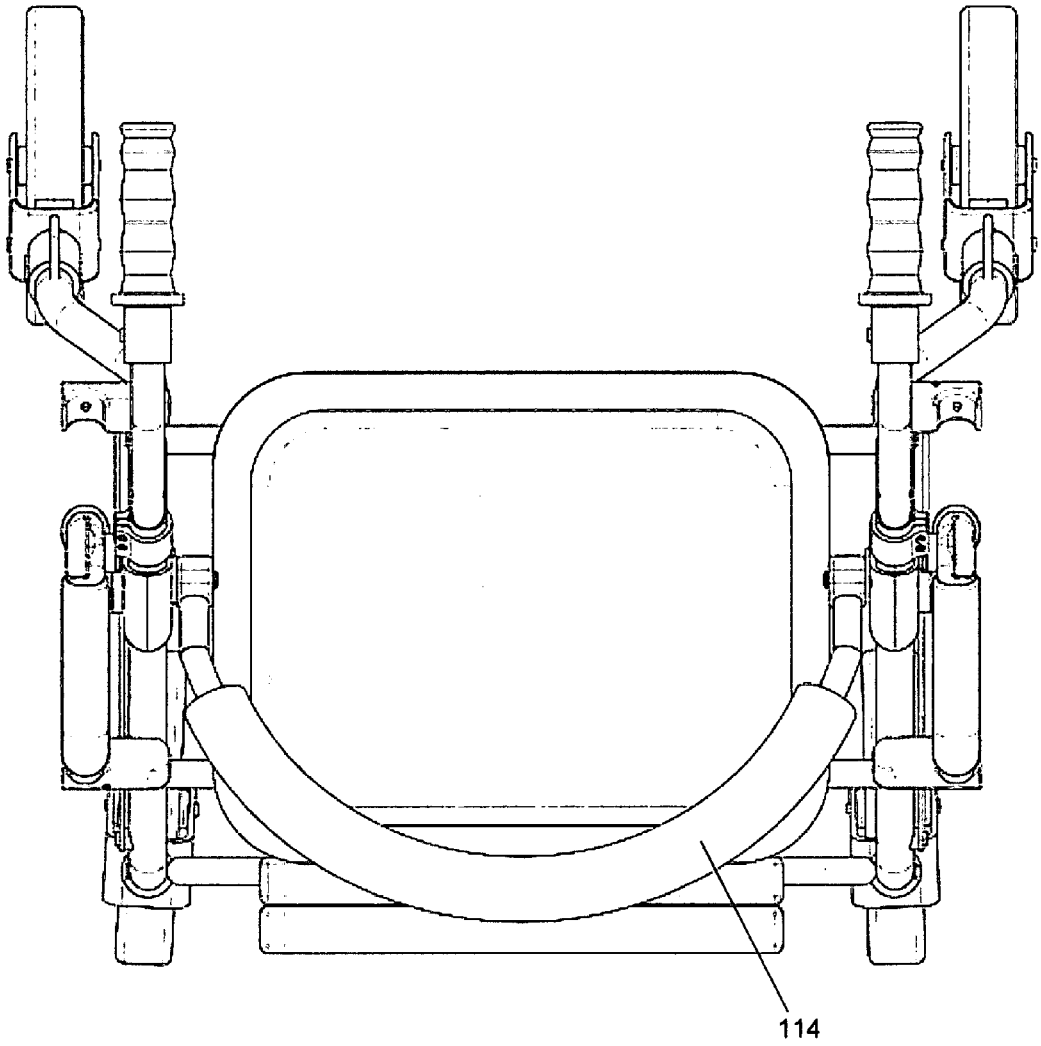
FIG. 2 is a top view of a reversible rolling walker in the walking configuration.
Figure 3:
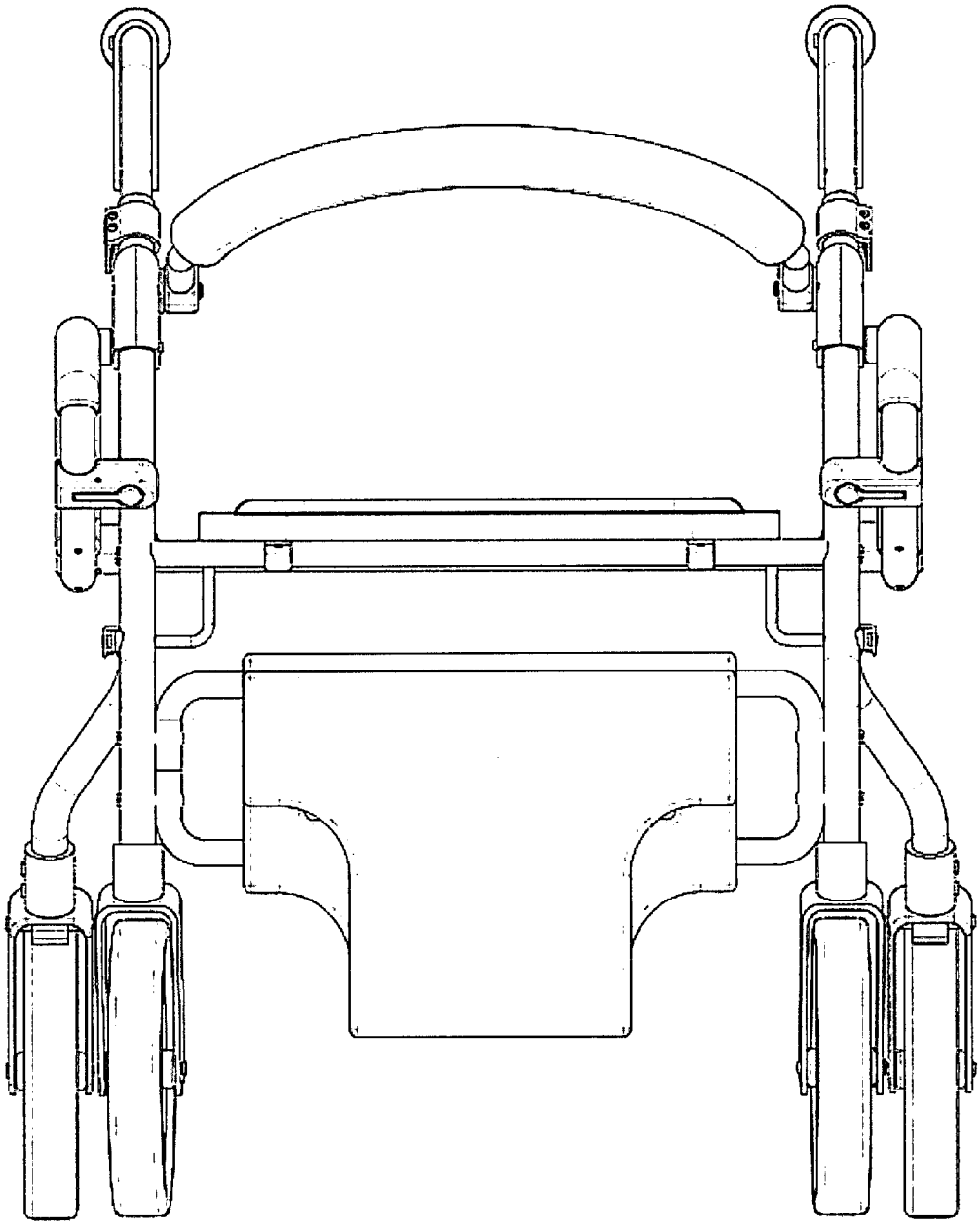
FIG. 3 is a front view of a reversible rolling walker in the walking configuration.
Figure 4:
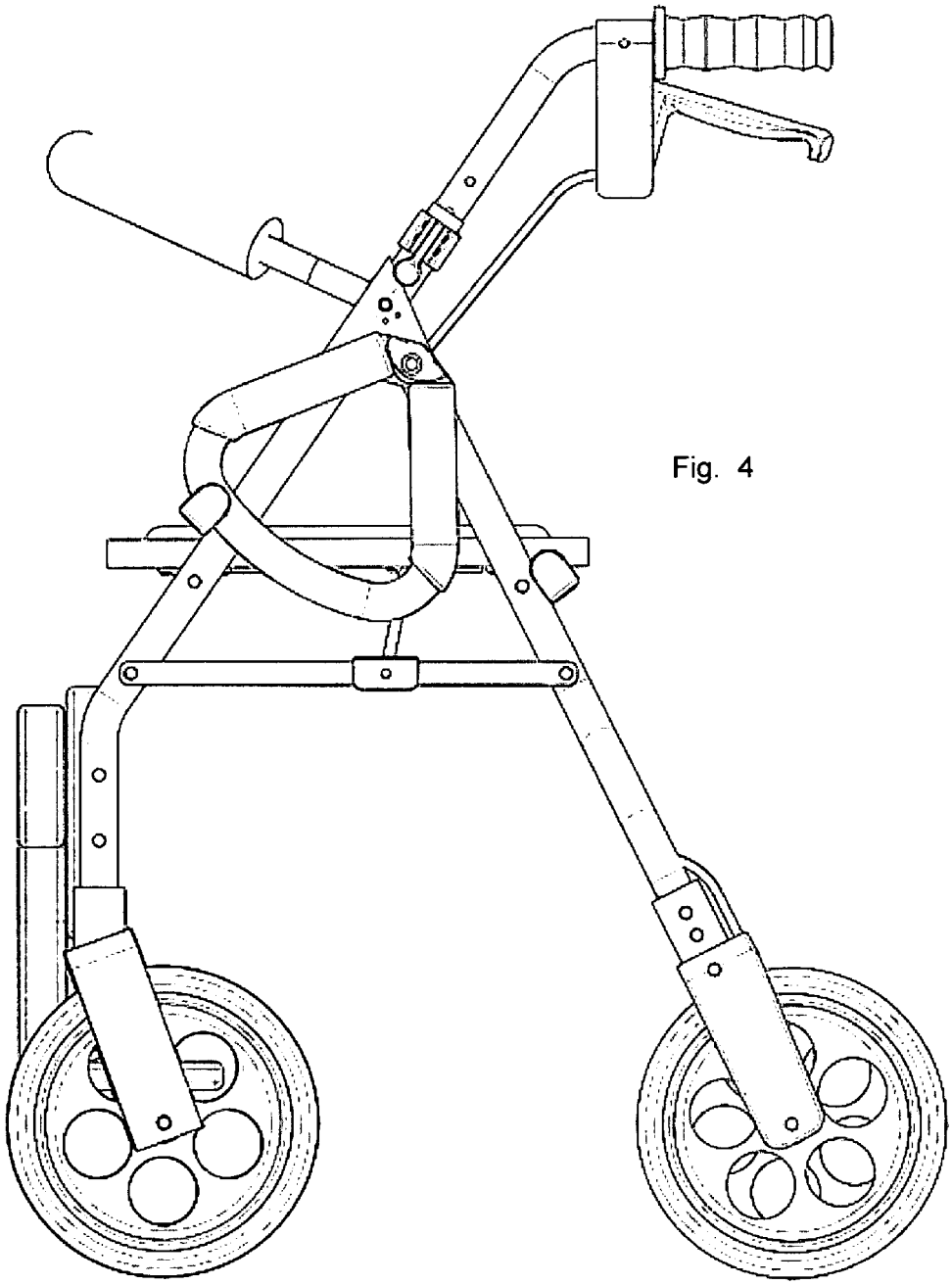
FIG. 4 is a side view of a reversible rolling walker in the walking configuration.

FIG. 2 provides a top view of the reversible rolling walker in the walking configuration. It can be clearly seen in FIG. 2 that backrest 114 is swiveled away from the handgrip side of the walker. FIG. 3 provides a front view of the reversible rolling walker in the walking configuration, and illustrates the difference in the lateral spacing of the front wheels as compared to the lateral spacing of the back wheels. In other words, the rear wheels are spaced further apart than the front wheels so that upon folding the walker may be in a compact form wherein all the wheels are substantially axially aligned. FIG. 4 is a side view of the reversible rolling walker in the walking configuration, and shows arm 126 latched in locking engagement with front arm latch 128.

Figure 6:
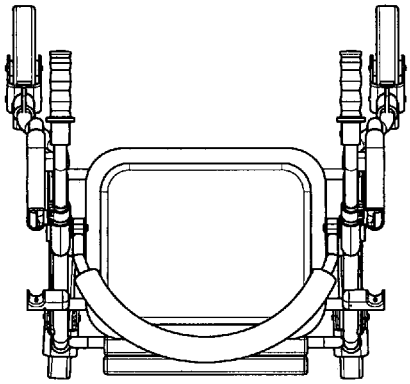
FIG. 6 is a top view of a reversible rolling walker in the rear-facing chair configuration.
Figure 5:
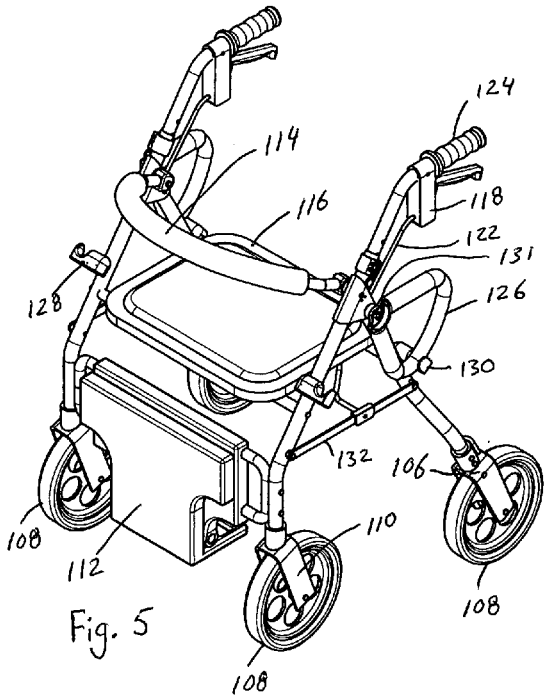
FIG. 5 is an isometric view of a reversible rolling walker, in accordance with the present invention, in the rear-facing chair configuration.
Figure 7:
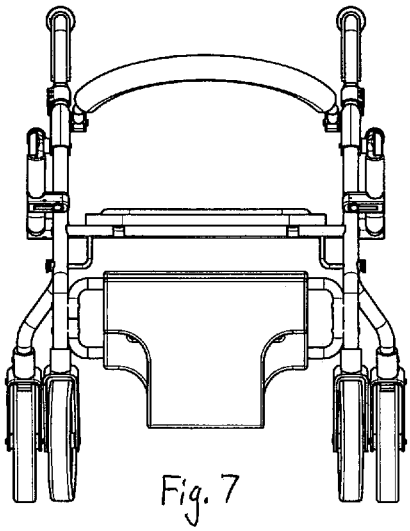
FIG. 7 is a front view of a reversible rolling walker in the rear-facing chair configuration.
Figure 8:
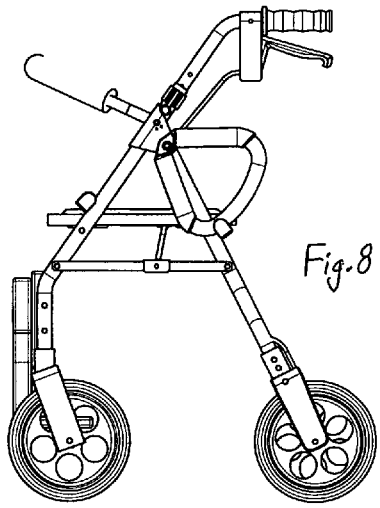
FIG. 8 is a side view of a reversible rolling walker in the rear-facing chair configuration.
Figure 19:
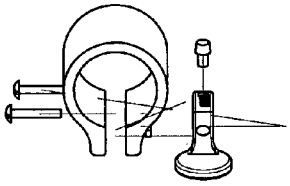
FIG. 19 is an exploded view of an illustrative hinge collar, in accordance with the present invention, which is made from plastic, although the material composition of the hinge collar is not a limitation of the present invention.
Figure 18:
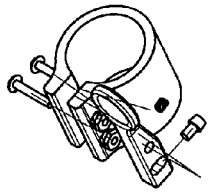
FIG. 18 is an exploded view of an illustrative hinge collar, in accordance with the present invention, which is made from plastic, although the material composition of the hinge collar is not a limitation of the present invention.
Figure 20:
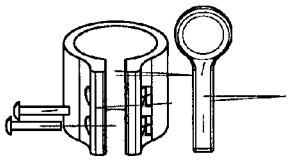
FIG. 20 is an exploded view of an illustrative hinge collar, in accordance with the present invention, which is made from plastic, although the material composition of the hinge collar is not a limitation of the present invention.
Figure 21:
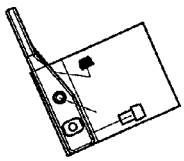
FIG. 21 is an exploded view of an illustrative hinge collar, in accordance with the present invention, which is made from plastic, although the material composition of the hinge collar is not a limitation of the present invention.
Figure 22:
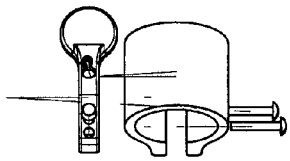
FIG. 22 is an exploded view of an illustrative hinge collar, in accordance with the present invention, which is made from plastic, although the material composition of the hinge collar is not a limitation of the present invention.

FIGS. 5-8 provide various views of a reversible rolling walker in accordance with the present invention arranged in the rear-facing chair configuration. The rear-facing chair configuration is one in which the various elements of the reversible rolling walker in accordance with the present invention are arranged for convenient use as an assistive device for sitting while facing outward from the handgrip side, or back, of the walker. More particularly, FIG. 5 provides an isometric view of a reversible rolling walker, in accordance with the present invention, in the rear-facing chair configuration. FIG. 5 is similar to FIG. 1, but shows arm 126 in locking engagement with rear arm latch 130. FIGS. 6-8 are similar to FIGS. 2-4, but show arm 126 as it would appear in various views while engaged with rear arm latch 130.

It is noted that arms 126 can be used in three positions. Arms 126 swing and latch in the forward position for forward-facing seating; swing and latch in the backward position for rear-facing seating; and arms 126 also latch in both the front and rear latches in the closed position thereby latching the reversible rolling walker in the folded position. Arms 126 can also be set in a number of down positions where the arms are substantially down and out of the way. One of these configurations is shown in FIG. 1, where the arms are latched to the front arm latch 128. Arms 126 can also be latched to the rear arm latch in the down position.

FIGS. 9-13 show various views of the reversible rolling walker in accordance with the present invention while in transition, or transformation from the walking configuration to the front-facing chair configuration. More particularly, FIG. 9 is an isometric view of the reversible rolling walker, in accordance with the present invention, in the transformation configuration, where the walker is shown approximately midway through changing from a walking configuration to a front-facing configuration. FIG. 9 is similar to FIG. 1, but shows footrest 111 unfolding away from footrest backing plate 113, and also shows backrest 114 mid-way through moving from the front side of the walker to the rear side of the walker. It is noted that each arm 126 is latched to a corresponding front arm latch 128. FIG. 10 provides a top view of the reversible rolling walker in the transformation configuration, clearly showing the backrest 114 in transition. FIG. 11 provides a front view of the reversible rolling walker in the transformation configuration. FIG. 12 provides a side view of the reversible rolling walker in the transformation configuration. FIG. 13 provides a rear view of the reversible rolling walker in the transformation configuration.

FIGS. 14-17 show various views of the reversible rolling walker in accordance with the present invention in the front-facing chair configuration. More particularly, FIG. 14 provides an isometric view of the reversible rolling walker in the front-facing chair configuration. FIG. 14 is similar to FIG. 1, but shows footrest 111 fully deployed, or unfolded, and also shows backrest 114 deployed in the front-facing chair arrangement. FIGS. 15-17 provide, respectively, a top view, a front view, and a side view, of the reversible rolling walker in the front-facing chair configuration. By reversing the position of backrest 114, the present invention provides a forward-facing seating arrangement, and further provides a convenient arrangement for a person to push the walker. This is different from conventional wheeled walkers where a person must sit in a rear-facing seat thus making it very difficult for a helper to reach the hand grips and push the walker.

FIGS. 18-22 are exploded views of a plastic hinge collar, in accordance with the present invention, in various orientations. The plastic hinge collar allows arm 126 to rotatably travel between front arm latch 128 and rear arm latch 130. It is noted that the hinge collar may be formed from any suitable material and is not limited to plastic.

Figure 24:
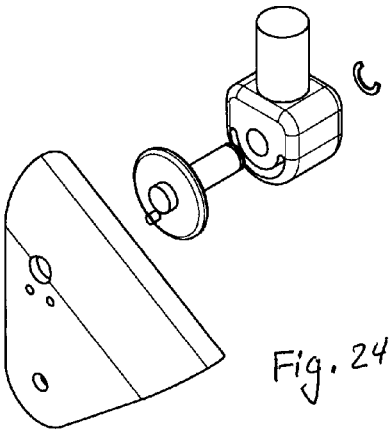
FIG. 24 is an exploded view of a backrest hinge in accordance with the present invention.
Figure 23:
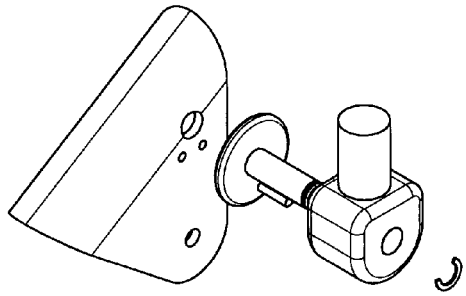
FIG. 23 is an exploded view of a backrest hinge, in accordance with the present invention.
Figure 25:
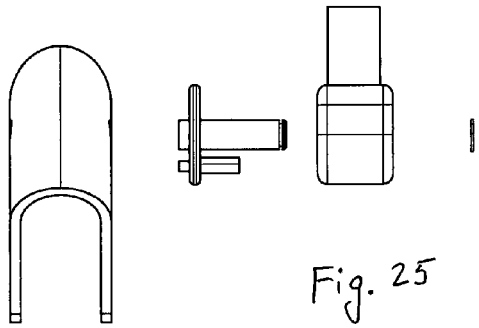
FIG. 25 is an exploded view of a backrest hinge in accordance with the present invention.
Figure 27:
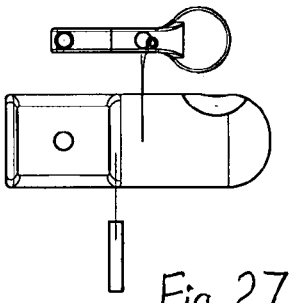
FIG. 27 is an exploded view of an arm latch assembly in accordance with the present invention.
Figure 26:
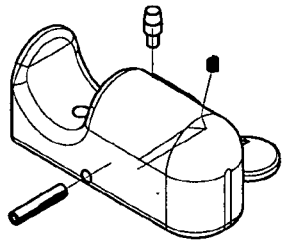
FIG. 26 is an exploded view of an arm latch assembly, in accordance with the present invention.
Figure 28:
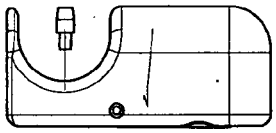
FIG. 28 is an exploded view of an arm latch assembly in accordance with the present invention.
Figure 29:
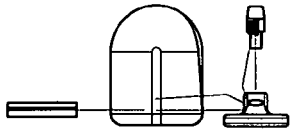
FIG. 29 is an exploded view of an arm latch assembly in accordance with the present invention.
Figure 30:
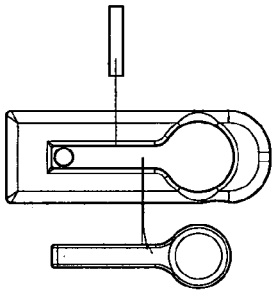
FIG. 30 is an exploded view of an arm latch assembly in accordance with the present invention.
Figure 31:
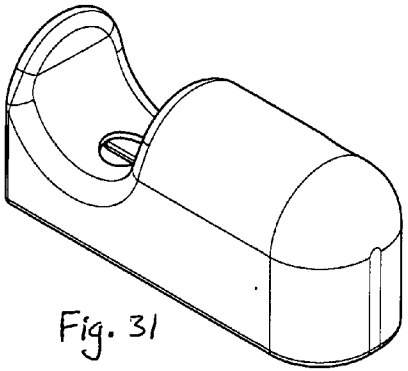
FIG. 31 is an isometric view of an alternative arm latch, in accordance with the present invention.
Figure 34:
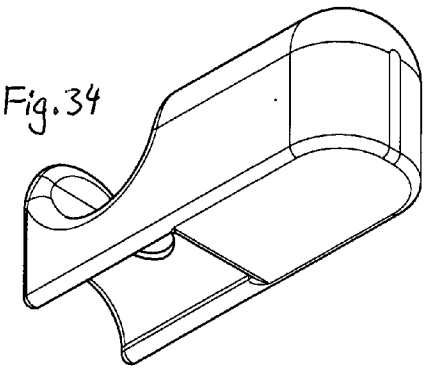
FIG. 34 is an isometric view of an alternative arm latch in accordance with the present invention.
Figure 35:
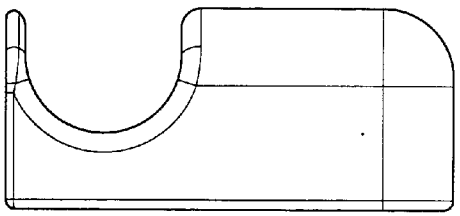
FIG. 35 is a side view of the alternative arm latch shown in FIGS. 31-34.
Figure 32:
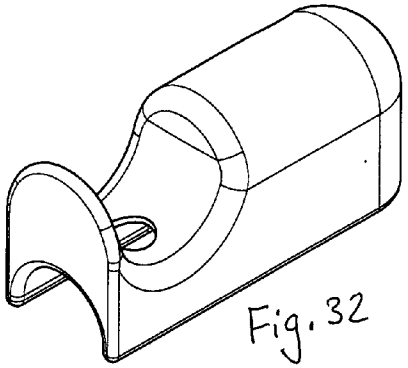
FIG. 32 is an isometric view of an alternative arm latch in accordance with the present invention.
Figure 33:
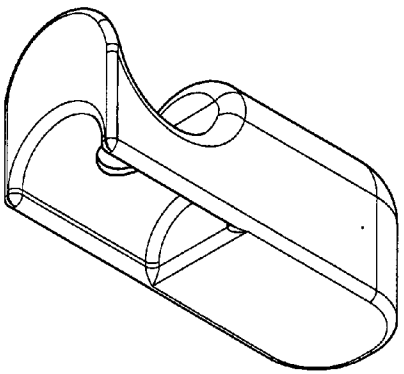
FIG. 33 is an isometric view of an alternative arm latch in accordance with the present invention.

FIGS. 23-25 are exploded views of a backrest hinge, in accordance with the present invention, in various orientations. As can be seen with further reference to FIG. 1, one backrest hinge 131 is attached to each of front members 102. In operation, the pair of backrest hinges 131 allow backrest 114 rotate between the front of the walker (i.e., the rear-facing chair configuration) and the rear of the walker (i.e., the front-facing chair configuration).

FIGS. 27-30 illustrate details of arm latch assembly 128, 130, as those are shown, for example, in FIG. 1. In the illustrative embodiments shown herein, front arm latch assembly 128 and rear arm latch assembly 130 are of the same design. As noted above, in connection with the description of FIG. 1, front arm latch 128 and rear arm latch 130 are used to lockingly engage with arm 126 so as to hold arm 126 in position when it is moved from, for example, the rear-facing seating configuration position to the forward-facing seating configuration position. Arm 126 may be disengaged from front arm latch 128 and rear arm latch 130 by pressing a button on the underside of arm latch assembly 128, 130. Once disengaged, arm 126 is free to rotate to a different position.

FIGS. 31-35 provide several views of an alternative arm latch 202 that includes a recess on its underside, that is, the side opposite to the side with which arm 126 engages. This underside recess in the arm latch allows a user to press a button to release, or disengage, arm 126 therefrom.

Referring to FIG. 1 and FIGS. 27-35, it is noted that any suitable arrangement for engaging and releasing rotatable arm 126 so that it stays in the desired position until intentionally released may be used. In some embodiments an engaging pin, or similar element, attached to the arm latch may mate with a recess or hole in the rotatable arm. In still other embodiments an engaging pin, or similar element, attached to the arm may mate with a recess or hole in the arm latch.

Figure 36:
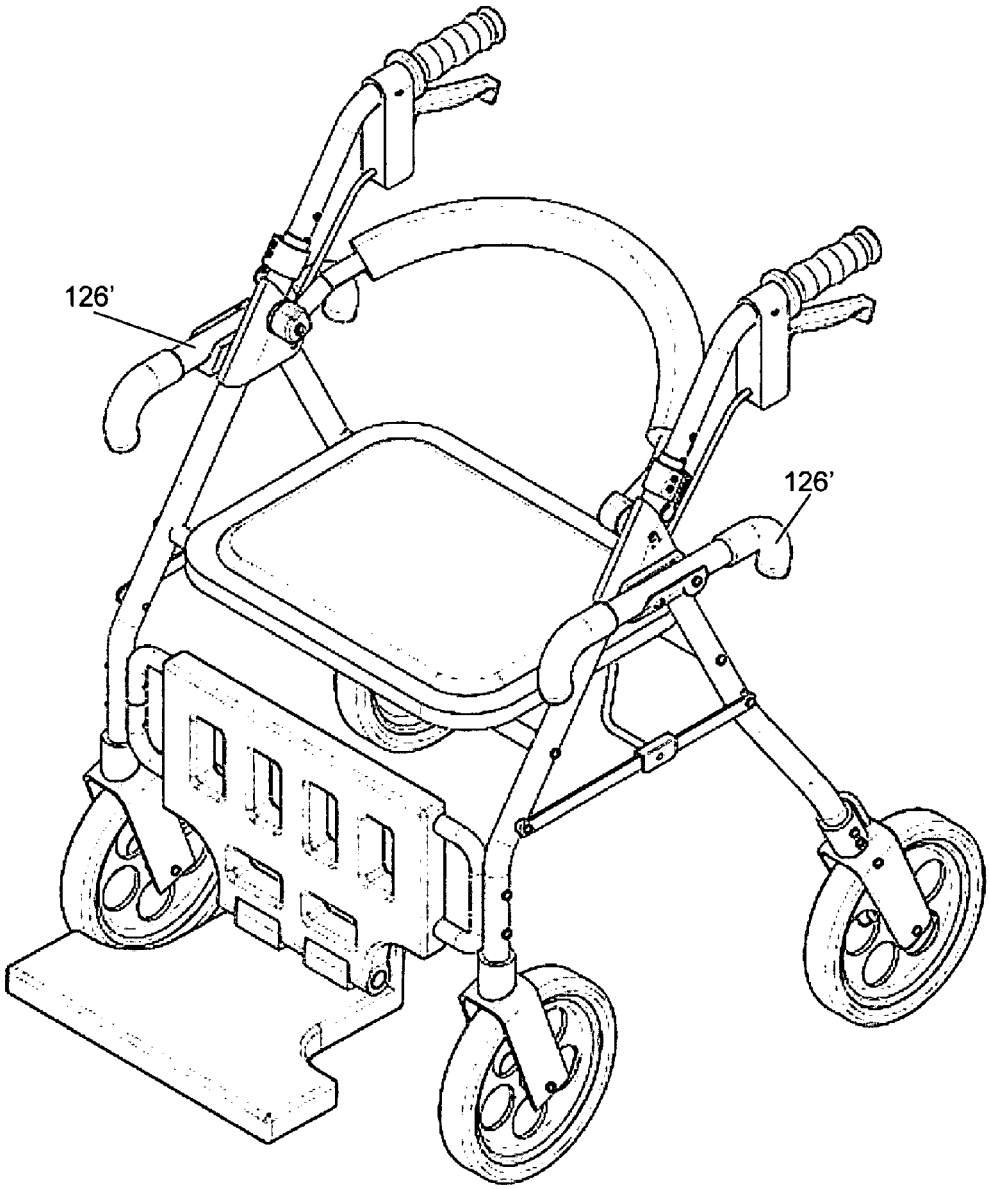
FIG. 36 is an isometric view of a reversible walker in accordance with the present invention having an alternative arm design, with the arm in the "down" position.
Figure 37:
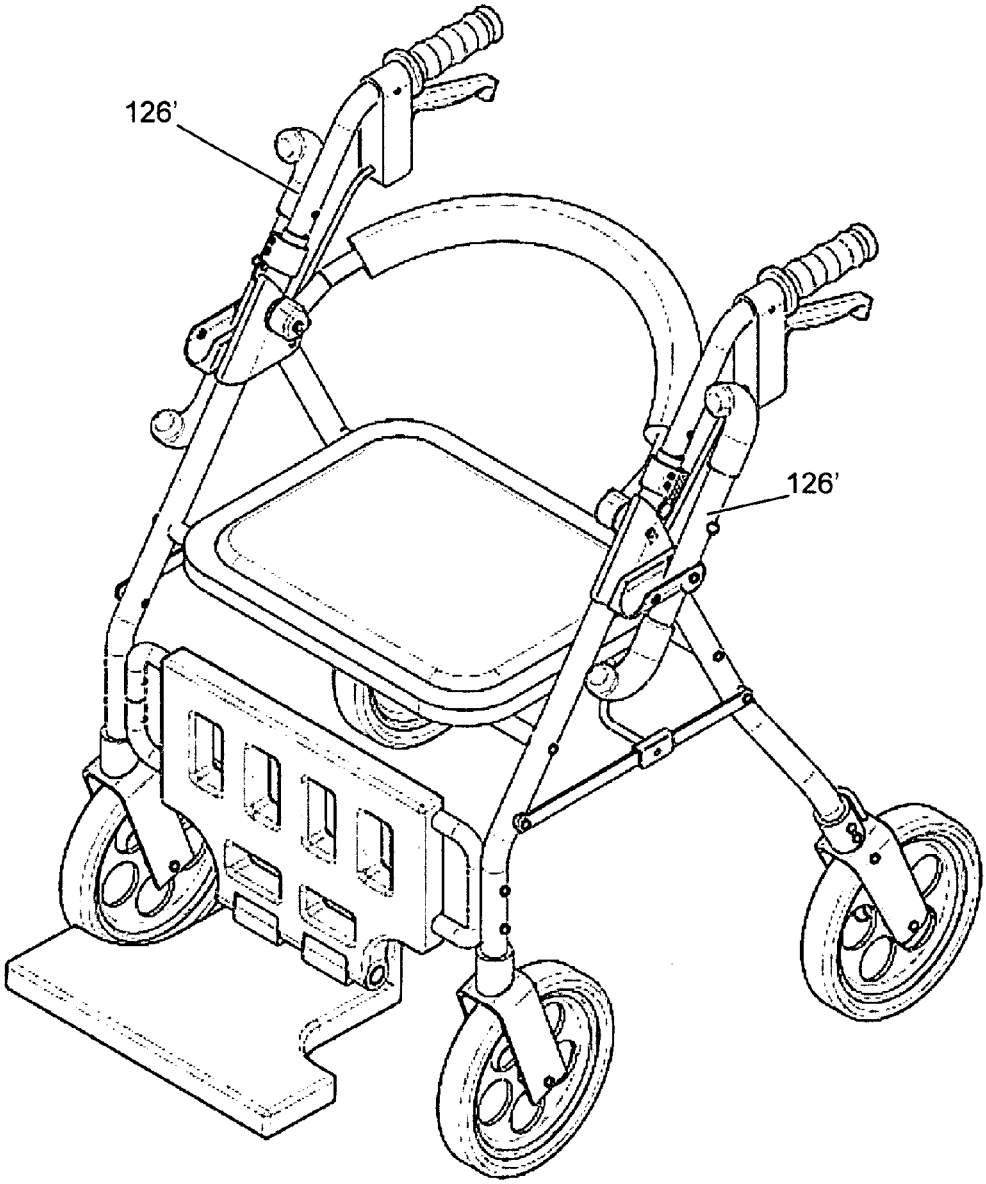
FIG. 37 is an isometric view of a reversible walker in accordance with the present invention having an alternative arm design, with the arm in the "up" position.

FIGS. 36 and 37 show a reversible walker, in accordance with the present invention, having an alternative arm design. FIG. 36 shows alternative arm 126' in the down position, and FIG. 37 shows alternative arm 126' in the up position. It is noted that alternative arms 126' are shaped so as to have a central portion that is substantially straight and handle portions at each end of the central portion, where the handle portions are curved in the shape of a quarter circle and are covered with any material suitable to act as a hand grip. Those skilled in the art and having the benefit of this disclosure will appreciate that further alternative arm designs are possible within the scope of the present invention.

Those skilled in the art and having the benefit of this disclosure will appreciate that the various structural elements of the reversible rolling walker described herein may be made from any suitable material. It is generally preferable for such materials to be strong and light weight.

In some embodiments, a basket or similar container is attached to the walker assembly under the seat. Similarly, other convenience features may be attached to the frame of the reversible rolling walker in accordance with the present invention. By way of example and not limitation, a pocket for a cellular phone or other consumer electronic product may be provided.

In one embodiment the reversible wheeled walker, of the present invention includes a frame having a left pair of front and rear members, and a right pair of front and rear members; the left pair and the right pair being spaced apart and substantially parallel to each other; a seat disposed between the left pair and the right pair, the seat coupled to the front and rear members of the left pair and to the front and rear member of the right pair; and a backrest rotatably attached to a first backrest hinge mounted on the front member of the left pair and further rotatably attached to a second backrest hinge mounted on the front member of the right pair. In some embodiments, a foldable footrest assembly disposed between the left pair and the right pair, the foldable footrest assembly attached to the front member of the left pair and the front member of the right pair, is also included.

It is noted that the footrest can be implemented as a hinged bar for the feet to rest on. Alternatively, the footrest can be implemented as two individual hinged foot pegs.

CONCLUSION

Described herein are illustrative embodiments of a reversible walker assembly that finds application in the field of assisted human locomotion and transport.

An advantage of some embodiments of the present invention is that reconfiguration from rear-facing to forward-facing arrangements is provided, and is easily performed.

Another advantage of some embodiments of the present invention is that the reversible rolling walker may be occupied by a person in a front-facing seating arrangement and still provide access to the hand grips and hand brakes for an assistant to easily push the wheeled walker in the forward direction.

Another advantage of some embodiments of the present invention is that a foldable foot-rest is provided, and in the forward-facing seating arrangement, the foldable foot-rest may be folded down to provide support for a person's feet.

It is to be understood that the present invention is not limited to the embodiments described above, but encompasses any and all embodiments within the scope of the subjoined Claims and their equivalents.

What is claimed is:

1. A reversible wheeled walker, comprising a frame having a left pair of front and rear members, and a right pair of front and rear members; the left pair and the right pair being spaced apart and substantially parallel to each other;

a footrest assembly disposed between the left pair and the right pair, the footrest assembly attached to the front member of the left pair and the front member of the right pair;

a seat disposed between the left pair and the right pair, the seat coupled to the front and rear members of the left pair and to the front and rear member of the right pair;

a backrest rotatably attached to a first backrest hinge mounted on the front member of the left pair and further rotatably attached to a second backrest hinge mounted on the front member of the right pair;

a first arm rotatably attached to a first arm hinge;

a first front arm latch attached to the front member of the left pair; and a first rear arm latch attached to the rear member of the left pair;

wherein the first front arm latch and the first rear arm latch are operable to lockingly engage the first arm, and are further operable to release the latched first arm; and a first foldable cross-support attached at a first end thereof to the front member of the left pair and attached at a second end thereof to the rear member of the left pair, the cross-support foldable at a mid-portion thereof.

2. The reversible wheeled walker of claim 1, further comprising:

a second arm rotatably attached to a second arm hinge;

a second front arm latch attached to the front member of the right pair; and a second rear arm latch attached to the rear member of the right pair;

wherein the second front arm latch and the second rear arm latch are operable to lockingly engage the second arm, and are further operable to release the latched second arm.

3. The reversible wheeled walker of claim 2, wherein the first and second arms are each at least partially covered with a padding material.

4. The reversible wheeled walker of claim 2, wherein the first and second arms are each at least partially covered with a rubber layer.

5. The reversible wheeled walker of claim 1, wherein the backrest comprises a structural element at least partially surrounded by a covering material, the structural element selected from the group consisting of a tubular element, a flat element, a square element, and a rectangular element.

6. The reversible wheeled walker of claim 1, wherein the front and rear members of the left and right pairs comprise tubular structures, and further comprising at least one wheel coupled to each of the front and rear members of the left and right pairs.

7. The reversible wheeled walker of claim 1, further comprising a first hand brake mechanism disposed on the front member of the left pair and the end of said member opposite the wheel attached to said member; wherein the hand brake mechanism is operable to turn sideways to facilitate folding of the reversible wheeled walker.

8. A wheeled walker, comprising:

a frame having a left pair of front and rear members, and a right pair of front and rear members; the left pair and the right pair being spaced apart and substantially parallel to each other;

a seat disposed between the left pair and the right pair, the seat coupled to the front and rear members of the left pair and to the front and rear members of the right pair; and a backrest rotatably attached to a first backrest hinge mounted on the front member of the left pair and further rotatably attached to a second backrest hinge mounted on the front member of the right pair;

a first arm rotatably attached to a first arm hinge disposed on the frame;

a first front arm latch attached to the front member of the left pair;

a first rear arm latch attached to the rear member of the left pair;

a second arm rotatably attached to a second arm hinge disposed on the frame;

a second front arm latch attached to the front member of the right pair; and a second rear arm latch attached to the rear member of the right pair;

wherein the first front arm latch and the first rear arm latch are operable to lockingly engage the first arm, and are further operable to release the latched first arm; and wherein the second front arm latch and the second rear arm latch are operable to lockingly engage the second arm, and are further operable to release the latched second arm;

wherein when the wheeled walker is in the a folded configuration, the first arm is lockingly engaged with both the first front arm latch and the first rear arm latch; and the second arm is lockingly engaged with both the second front arm latch and the second rear arm latch.

9. The wheeled walker of claim 8, wherein the first arm hinge is disposed on the front member of the left pair; and wherein the second arm hinge is disposed on the front member of the right pair.

10. The wheeled walker of claim 8, wherein the first front arm latch, the second front arm latch, the first rear arm latch, and the second rear arm latch each include a recess on the underside thereof.

11. The wheeled walker of claim 8, wherein the first front arm latch, the second front arm latch, the first rear arm latch, and the second rear arm latch each include a button on the underside thereof.

12. The wheeled walker of claim 8, wherein the first arm is generally triangular in shape.

13. The wheeled walker of claim 8, wherein the first arm includes a substantially straight central portion and curved handle portions at each end of the central portion.

14. A wheeled walker, comprising:

a frame having a left pair of front and rear members, and a right pair of front and rear members; the left pair and the right pair being spaced apart and substantially parallel to each other;

a seat disposed between the left pair and the right pair, the seat coupled to the front and rear members of the left pair and to the front and rear members of the right pair;

a reversible cross-arm rotatably attached to a first backrest hinge mounted on the front member of the left pair and further rotatably attached to a second backrest hinge mounted on the front member of the right pair;

a first arm rotatably attached to a first arm hinge disposed on the frame;

a first front arm latch attached to the front member of the left pair;

a first rear arm latch attached to the rear member of the left pair;

a second arm rotatably attached to a second arm hinge disposed on the frame;

a second front arm latch attached to the front member of the right pair; and a second rear arm latch attached to the rear member of the right pair;

wherein the first front arm latch and the first rear arm latch are operable to lockingly engage the first arm, and are further operable to release the latched first arm;

wherein the second front arm latch and the second rear arm latch are operable to lockingly engage the second arm, and are further operable to release the latched second arm; and wherein when the reversible cross-arm is disposed in a first position the wheeled walker is configured as a forward-facing wheeled walker, and when the reversible cross-arm is rotated to a second position the wheeled walker is configured as a rear-facing wheeled walker.

15. The wheeled walker of claim 14, wherein each of the first arm and the second arm are operable to at least partially rotate in a plane.

16. The wheeled walker of claim 14, wherein the first arm hinge is disposed on the front member of the left pair; and wherein the second arm hinge is disposed on the front member of the right pair.

17. The wheeled walker of claim 14, wherein when the wheeled walker is in a folded configuration, the first arm is lockingly engaged with both the first front arm latch and the first rear arm latch; and the second arm is lockingly engaged with both the second front arm latch and the second rear arm latch.

18. The wheeled walker of claim 14, wherein the first front arm latch, the second front arm latch, the first rear arm latch, and the second rear arm latch each include a recess on the underside thereof.

19. The wheeled walker of claim 14, wherein the first front arm latch, the second front arm latch, the first rear arm latch, and the second rear arm latch each include a button on the underside thereof.

* * * * *